US005378022A

United States Patent [19]

French et al.

[11] Patent Number: 5,378,022

[45] Date of Patent: Jan. 3, 1995

[54] POUCH FOR PAPER NOTEBOOKS

[76] Inventors: Diana J. French; Charlotte M. Odau, both of 2009 Linden Lake Rd., Fort Collins, Colo. 80524

[21] Appl. No.: 152,188

[22] Filed: Nov. 12, 1993

[51] Int. Cl.[6] ..... B42D 3/00

[52] U.S. Cl. ..... 281/31; 281/29; 281/51

[58] Field of Search ..... 281/29, 30, 31, 15.1, 281/51; 402/79

[56] References Cited

U.S. PATENT DOCUMENTS 2,677,376 5/1954 Brunner ..... 281/29
4,893,837 1/1990 Pagliese et al. ..... 281/31
4,961,596 10/1990 Moor ..... 281/31
4,986,572 1/1991 Kaykendall ..... 281/30
5,042,841 8/1991 Friedman ..... 281/31

*Primary Examiner*—Richard K. Seidel
*Assistant Examiner*—Hwei-Siu Payer
*Attorney, Agent, or Firm*—Dean P. Edmundson

[57] ABSTRACT

A pouch is described for attachment to the front cover of a notebook (e.g., a spiral wire bound notebook) for containing personal items such as pencils, erasers, rulers, calculator, etc. The pouch is preferably made of flexible plastic and includes a flap or other type of closure for closing an interior pocket. The pouch may include a sleeve for enabling the cover of a notebook to be slidably received therein so that the pouch is firmly held on to the cover. The pouch is removable from the cover.

4 Claims, 5 Drawing Sheets

POUCH FOR PAPER NOTEBOOKS

FIELD OF THE INVENTION

This invention relates to containers and other carrying devices for carrying personal items. More particularly, this invention relates to devices and containers which can be attached to notebooks or the like for carrying school items.

BACKGROUND OF THE INVENTION

Notebooks of the type in which a spiral wire serves as a binding to hold the pages and covers together are extremely common and are widely used, especially by students. One disadvantage of such notebooks, and also of other bound paper notebooks, is that they do not include any pockets or pouches for safely containing personal items such as pencils, erasers, markers, rulers, calculator, etc. which may be required when attending classes or when studying. Consequently, these types of personal items must be carried in purses, carry bags, pockets, attache cases, etc. This is not always convenient.

There has not heretofore been provided a pouch or other container for personal items which can be conveniently used in conjunction with a notebook (such as a spiral wire bound notebook).

SUMMARY OF THE INVENTION

In accordance with the present invention there is provided a pouch which can be attached to a conventional bound notebook for carrying a wide variety of personal items. The pouch includes one or more openable flaps or flanges enclosing one or more interior pockets for safely containing personal items.

In one embodiment the pouch includes a sleeve on its back side which enables the pouch to be slipped onto a cover of a notebook for normal use. The pouch can be removed from the cover easily when desired. Other types of attachment means can be used to attach the pouch to a notebook cover.

Preferably the pouch is made of flexible plastic which is tough and durable. Transparent plastic film is very useful for this purpose and it may be provided in any desired color.

The interior pocket(s) may be closed in a variety of manners, e.g., with a flap, a zipper, snaps, etc.

Other variants are possible without departing from the scope of this invention.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
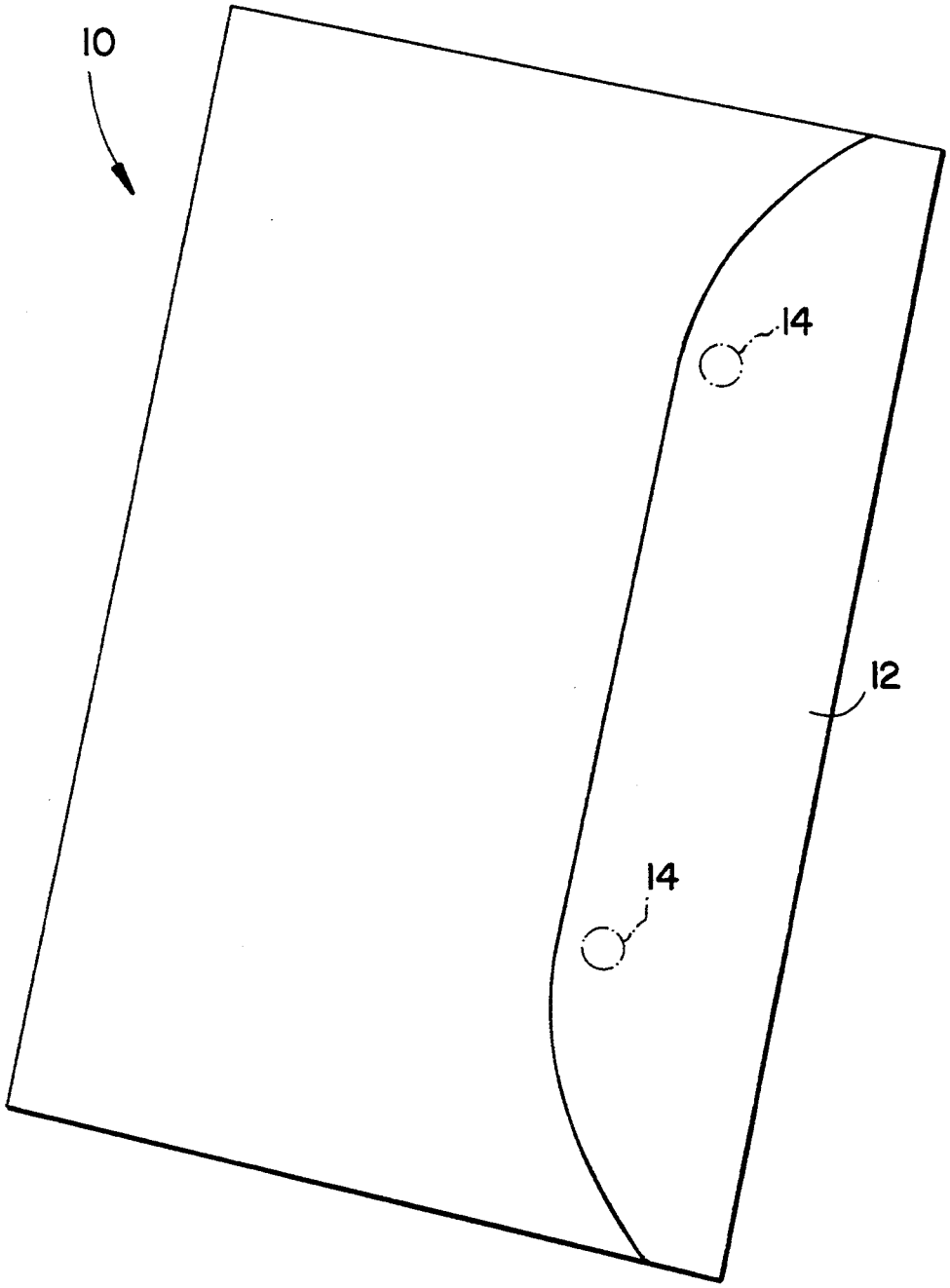
FIG 1 is a front perspective view of a pouch of the invention.
Figure 2:
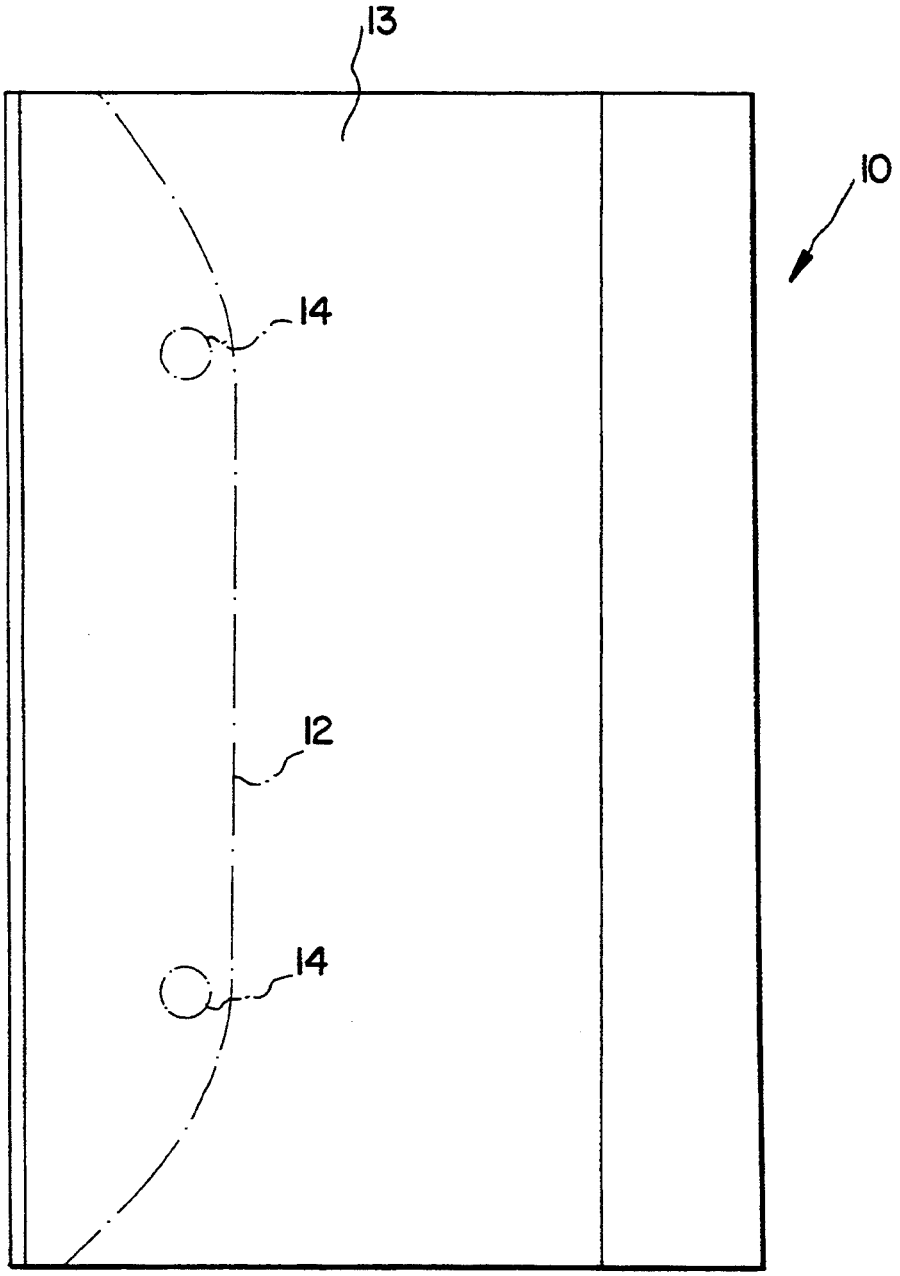
FIG. 2 is a rear elevational view of the pouch of FIG. 1.
Figure 3:
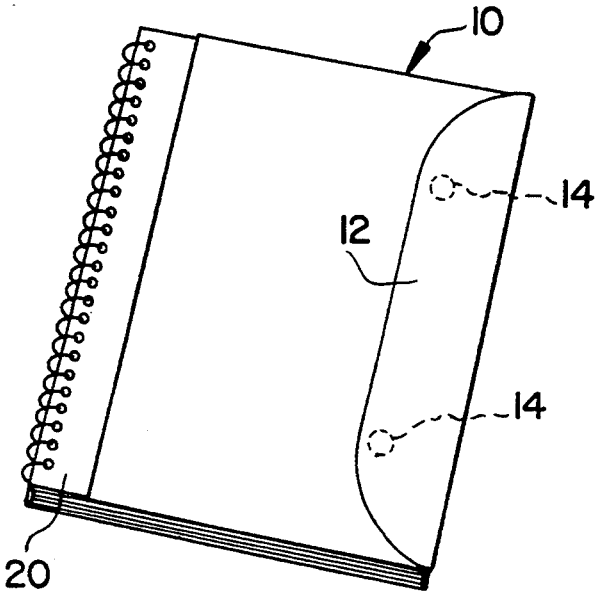
FIG. 3 illustrates the pouch attached to the front cover of a spiral wire bound notebook.
Figure 7:
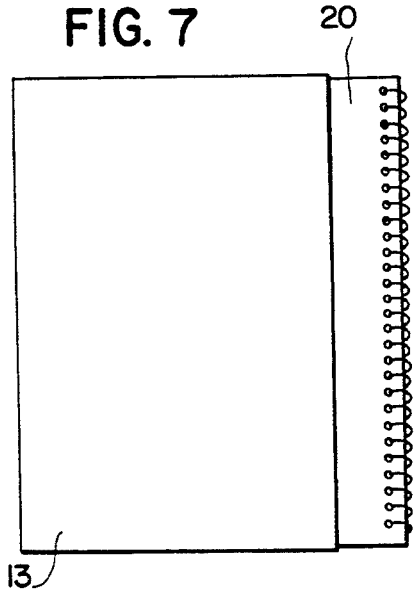

In the drawings there is shown a pouch 10 which includes an interior pocket and a flap 12 which extends along, and is folded over, one side edge of the pouch to close the pocket. The rear side of the pouch includes a sleeve portion 13 into which the cover 20 of a conventional notebook (e.g., a spiral wire bound notebook) is slidably received. The sleeve thus removably attaches the pouch to the cover of the notebook, as shown. The width of the sleeve may vary. It is also possible for one side edge of the sleeve portion, in addition to the top and bottom edges, to be secured to the pouch, as shown in FIGS. 2 and 7.

The flap 12 may be secured in its closed position in a variety of manners. A preferred manner of closing and securing the flap is by means of hook and loop fasteners 14. The loop portion of the fastener may be secured to the flap and the hook portion is secured to the outer wall of the pouch, or vice versa. One or more of such fasteners may be used in this manner. Other types of fasteners may be used, if desired, e.g., buttons, snaps, zippers, zip-lock, tongue-and-groove fasteners, adhesive strips, magnets, etc.

Figure 4:
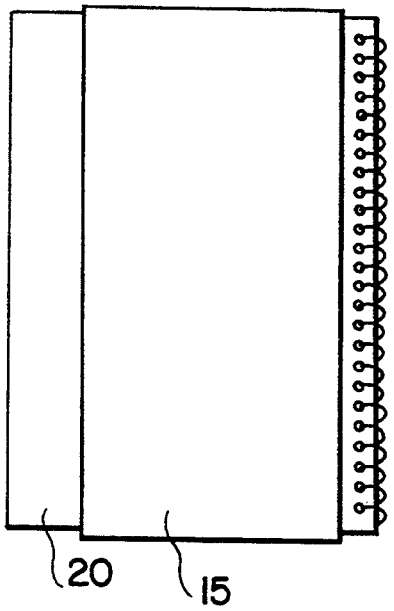
FIGS. 4–10 show other manners for attaching a pouch to the cover of a notebook.

The sleeve portion 15 shown in FIG. 4 has a width narrower than the width of cover 20 of a notebook. In this embodiment the cover of the notebook slides completely through the sleeve 15. The top and bottom edges of the sleeve, of course, are secured to the top and bottom edges of the pouch.

Figure 5:
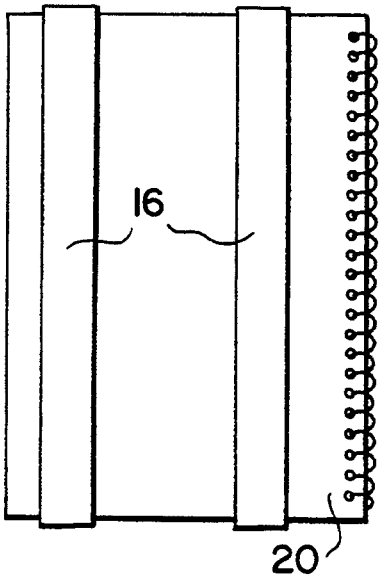
Figure 6:
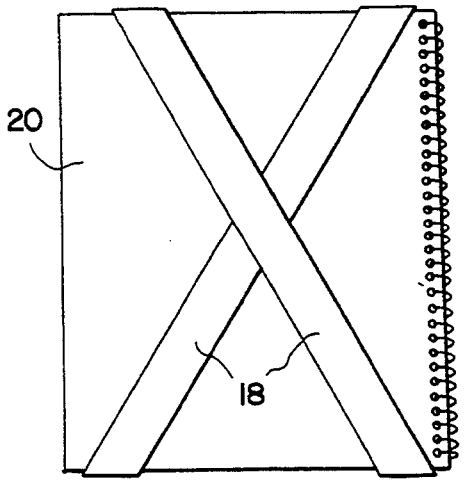

In FIG. 5 there is shown another embodiment of attachment means comprising separate straps or bands 16. The cover 20 slides completely through the straps (i.e., between the rear face of the pouch and the straps). In FIG. 6 there are shown straps 18 which are diagonal and which cross each other.

Figure 8:
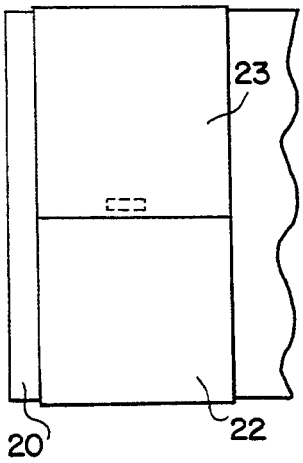

FIG. 8 illustrates air, other type of attachment means comprising straps 22 and 23. Strap 23 is secured to the lower end of the pouch and strap 23 is secured to the upper end of the pouch. The straps are positioned along the back side of the cover 20 and overlap each other. Mating fasteners (e.g., hook and loop fasteners) on the straps enable the straps to be secured together to hold the pouch on the cover 20.

Figure 9:
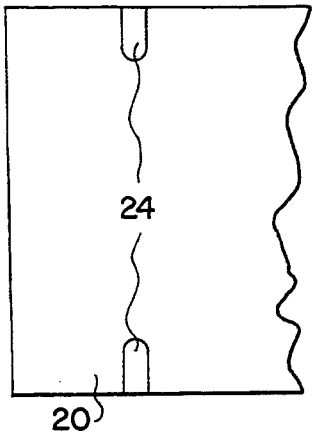
Figure 10:
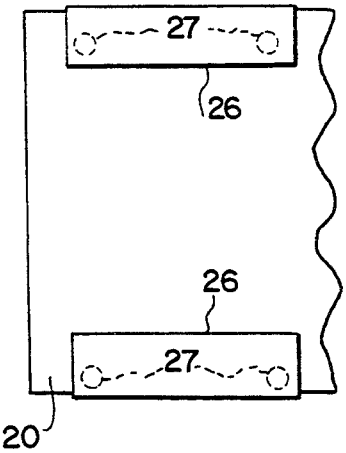

FIG. 9 illustrates the use of clips 24 to fasten the pouch to the cover 20. FIG. 10 shows yet another manner of fastening a pouch to the cover 20. In this embodiment flaps 26 on the pouch are folded against the back side of the cover 20 where they are secured by means of hook and loop fasteners 27.

Figure 11:
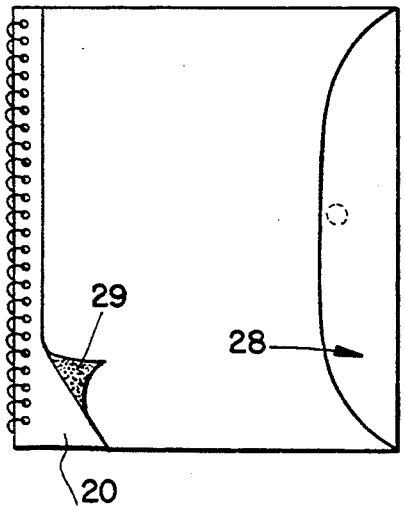
FIG. 11 shows attachment of the pouch to the front cover of a notebook using adhesive.

FIG. 11 shows a pouch 28 secured to the front face of cover 20 by means of an adhesive 29.

Figure 12:
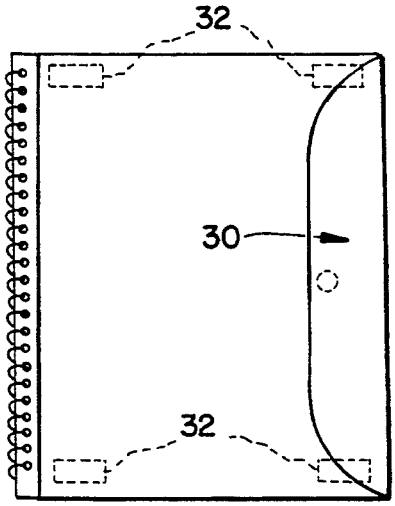
FIG. 12 shows attachment of the pouch to the front cover of a notebook using hook and loop fasteners.

FIG. 12 shows another embodiment of pouch 30 which is secured to the front face of a cover of a notebook by means of hook and loop fasteners 32. One portion of each fastener is secured to the cover (e.g., with adhesive) and the other portion is secured to the rear face of the pouch.

Figure 13:
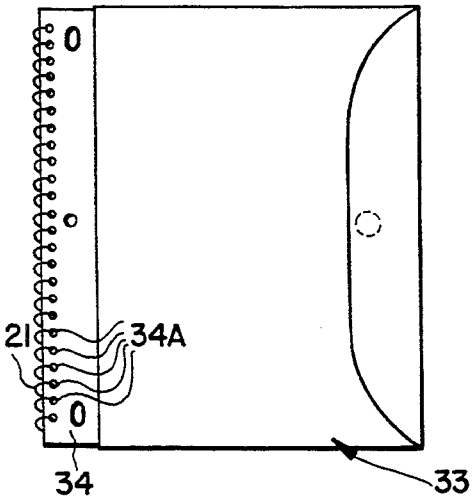
FIG. 13 shows the pouch secured to the spiral wire binding of a notebook.

In FIG. 13 there is shown another embodiment of pouch 33 which includes a side edge 34 which is perforated or otherwise provided with a plurality of openings 34A. This embodiment of pouch may be secured to the spiral wire binding 21 of the notebook (e.g., the pouch can be attached when the wire binding is passed through the notebook paper at the factory). The pouch can actually serve the purpose of the cover of the notebook. Alternatively, the openings along the side edge of the pouch 33 may be key-hole shaped so that the edge may be pressed against the spiral wire binding, whereby the edge of the pouch engages the spiral wire binding.

Figure 15:
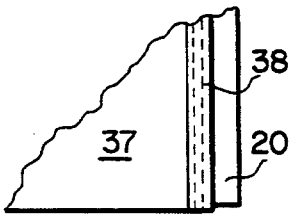
FIG. 15 and 16 show the use of other types of closures on a pouch.
Figure 16:
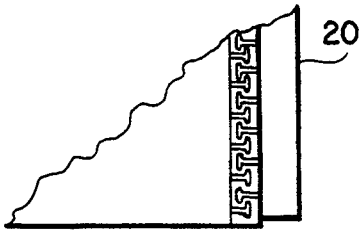

FIG. 15 illustrates the use of a tongue-in-groove closure (i.e., zip-lock closure) 38 for a pouch 37 on notebook cover 20, and FIG. 16 illustrates the use of a plastic zipper for closing a pouch.

Figure 14:
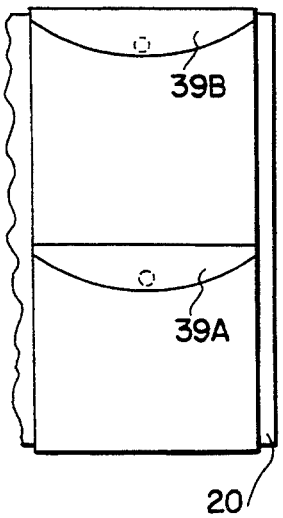
FIG. 14 is a front view of another embodiment of a pouch of the invention.

FIG. 14 shows another embodiment of pouch of the invention which includes two pockets. Separate flaps 39A and 39B provide access to the separate pockets.

Other variants are possible without departing from the scope of this invention. The pouch may be composed of any suitable material and may be made in any desired size.

What is claimed is:

1. In combination with a notebook of the type having a cover secured at one edge to a binding, a pouch having an interior pocket and closure means for closing said pocket; wherein said pouch includes a rear face; and further comprising attachment means on said rear face detachably securing said pouch to said cover; wherein said attachment means comprises a sleeve having upper and lower edges and a side edge; wherein said pouch includes upper and lower edges and a side edge; wherein said upper edge of said sleeve is secured to said upper edge of said pouch and said lower edge of said sleeve is secured to said lower edge of said pouch, and wherein said side edge of said sleeve is secured to said side edge of said pouch.

2. A combination in accordance with claim 1, wherein said closure means comprises a flap which is movable between open and closed positions; wherein said flap is held in said closed position by means of hook and loop fasteners.

3. A pouch for containing personal items, said pouch including an interior pocket and closure means for closing said pocket; wherein said pouch includes a rear face; and further comprising attachment means on said rear face for enabling said pouch to be attached to a notebook cover; wherein said attachment means comprises a sleeve having upper and lower edges; wherein said pouch includes upper and lower edges; wherein said upper edge of said sleeve is secured to said upper edge of said pouch, and said lower edge of said sleeve is secured to said lower edge of said pouch; wherein said sleeve and said pouch each include a side edge; and wherein said side edge of said sleeve is secured to said side edge of said pouch.

4. A pouch in accordance with claim 3, wherein said closure means comprises a flap which is movable between open and closed positions; and wherein said flap is held in said closed position by means of hook and loop fasteners.

* * * * *